United States Patent [19]
Knaflic et al.
[11] 4,229,175
[45] Oct. 21, 1980

[54] LIME-FREE AND SULFIDE-FREE LIMING PROCESS

[75] Inventors: France Knaflic, Frankenthal; Franz-Friedrich Miller, Ludwigshafen, both of Fed. Rep. of Germany

[73] Assignee: BASF Aktiengesellschaft, Ludwigshafen, Fed. Rep. of Germany

[21] Appl. No.: 889,835

[22] Filed: Mar. 24, 1978

[30] Foreign Application Priority Data

Apr. 2, 1977 [DE] Fed. Rep. of Germany ..... 2714813

[51] Int. Cl.[2] ..... C14C 1/00; C14C 1/08
[52] U.S. Cl. ..... 8/94.17; 8/94.15; 8/94.16; 8/94.18
[58] Field of Search ..... 8/94.16, 94.15, 94.18, 8/94.17

[56] References Cited

U.S. PATENT DOCUMENTS

| | | | |
|---|---|---|---|
| 2,123,832 | 7/1938 | Jaeger et al. | 8/94.17 |
| 2,266,448 | 12/1941 | Trosken | 8/94.17 |
| 2,639,967 | 5/1953 | Rudy | 8/94.17 |
| 3,254,938 | 6/1966 | Rodriguez et al. | 8/94.16 |
| 3,429,648 | 2/1969 | Langley | 8/94.16 |
| 3,751,221 | 8/1973 | Elvrum | 8/94.16 |
| 3,799,737 | 3/1973 | Elvrum | 8/94.16 |
| 3,920,388 | 11/1975 | Weaver et al. | 8/94.18 |
| 3,997,290 | 12/1976 | del Cueto | 8/94.16 |

*Primary Examiner*—A. Lionel Clingman
*Attorney, Agent, or Firm*—Keil & Witherspoon

[57] ABSTRACT

A continuous liming process using sodium hydroxide solution and sodium sulfate and/or sodium salts of dicarboxylic acids, instead of conventional liming components.

7 Claims, No Drawings

LIME-FREE AND SULFIDE-FREE LIMING PROCESS

The present invention relates to an economical liming process which can be carried out continuously, does not pollute the environment, and employs, instead of the conventional liming components (lime and keratolytic substances, especially sulfides), sodium hydroxide solution and sodium sulfate or a sodium salt of a dicarboxylic acid or, preferably, a mixture of sodium sulfate with a sodium salt of a dicarboxylic acid.

Animal hides consist of several layers, of which only the corium is suitable for the manufacture of leather.

The subcutaneous connective tissue can be removed mechanically, whilst the epidermis and hair must be loosened enzymatically or, at the present time, mostly by chemical agents, to the extent that they can either be removed mechanically or pulped and can be washed off. Simultaneously with the loosening or pulping of the hair, changes in the collagen fiber structure itself, referred to as opening up of the skin, take place, which have an advantageous effect on the character of the leather, as does a swelling of the hide, which however must be kept within appropriate limits.

In contrast to collagen, the main chains of which are principally linked by secondary valencies, the elementary fibers of the keratines are firmly linked by the main valency disulfide bridges of the cystine. The resistance of the hair is only weakened when the cystine bridges are cleaved, which can ultimately lead to a disintegration of the keratin structure.

A liming composition at the present time generally consists of an aqueous slurry of lime (more precisely, slaked lime or calcium hydroxide $Ca(OH)_2$) and sodium sulfide, in which the main purpose of the lime is to cause a slight, alkaline opening up of the entire hide, whilst the sodium sulfide, as a result of its cleaving action of cystine groups, attacks soley the keratinous substances of the hide.

Lime is the cheapest of all bases and not only ensures, because of its low solubility in water, that harmfully high concentrations of base cannot occur, but also represents an optimum combination of hair-loosening power, opening up of the hide and swelling of the hide. Thus, according to H. Herfeld, Grundlagen der Lederherstellung, Verlag Theodor Steinkopff, Dresden and Leipzig 1950, page 93, the hair-loosening power (which is the factor of prime importance) of the hydroxides increases from left to right in the series K—Na—Ba—Sr—Ca whilst the swelling power (which is generally too high) decreases from left to right. The ratio of opening up of the hide to swelling of the hide is also at an advantageous level if lime is employed. Accordingly, both economic aspects and all technical aspects argue for the use of lime. This is the reason for the age-old dominant position of lime in leather liming processes, which it has retained to the present day. To assist the hair-loosening action of lime, a keratolytic agent is as a rule added, and in particular, as stated above, this agent is in most cases a sulfide.

However, this conventional liming process also suffers from disadvantages. It is not particularly suitable for continuous operation—which at the present time is generally preferred—since the undissolved part of the lime can hardly be separated from the organic constituents of the liming sludge. This means not only a high comsumption of chemicals, but also severe pollution of the effluent, especially since sulfides are toxic.

It is an object of the present invention to provide a liming process which avoids these disadvantages without introducing new disadvantages.

We have found that this object is achieved by a lime-free and sulfide-free liming process, wherein a combination of sodium hydroxide solution and (as an agent for controlling the swelling of the hide being limed) sodium sulfate and/or a sodium salt of a dicarboxylic acid of 3 to 6 carbon atoms is employed.

Although reference is made to a lime-free and sulfide-free liming process, this freedom is of course not to be taken to mean chemical purity. On the contrary, as a rule small amounts of lime (in the form of calcium bicarbonate), inter alia originating from the water used, and especially in continuous operation, even substantial amounts of sulfide from the keratin of the epidermis, will be present in the solution. The terms lime-free and sulfide are merely intended to convey that neither is added as a chemical for the liming process.

Instead of sodium hydroxide solution it is also possible to use, for example, potassium hydroxide solution. For economic reasons alone, sodium hydroxide solution is preferred to other caustic alkalis, especially to potassium hydroxide solution. The concentration of sodium hydroxide (or potassium hydroxide) is suitably from 15 to 150 g of NaOH or KOH per liter of liming liquor, depending on whether a short or long liquor is used and depending on the desired degree of degradation of keratinous substances.

To diminish the hide-swelling action of the caustic alkali, sodium sulfate or, preferably, a sodium salt of a dicarboxylic acid of 3 to 6 carbon atoms, e.g. of malonic acid, succinic acid, glutaric acid, adipic acid, maleic acid or fumaric acid, or, in particular, a mixture of the sulfate and the salt of the dicarboxylic acid, is added to the liming composition. The proportion of the salt of the dicarboxylic acid should be at least 10, preferably more than 30, percent by weight of the salt mixture. The total concentration of the stated salts (sulfate and salts of dicarboxylic acids) is suitably from 50 to 200 g per liter of liming liquor, depending on the desired degree of swelling and of opening up of the hide.

In principle, it is of course also possible to use other water-soluble sulfates and other salts of dicarboxylic acids than the sodium salts, for example the potassium salts, but these are as a rule more expensive and offer no advantages over the sodium salts; the situation is thus the same as for the caustic alkali. Salts with other anions, for example sodium chloride, are however unsuitable.

The above disadvantage of the lower hair-loosening power of sodium hydroxide solution compared to that of lime is overcompensated by a higher concentration, and the disadvantage of the higher swelling power is eliminated by adding the salts. We have found that the salts of dicarboxylic acids suppress swelling more than opening up of the hide, whilst the converse is true of sodium sulfate. By balancing the concentration of caustic alkali relative to salts, and also balancing the concentration of salts of dicarboxylic acids relative to sodium sulfate, it is possible to adjust the swelling, opening up of the hide and course of the depilation (which may result in retention of the hair or pulping of the hair) in accordance with requirements, which may vary depending on the starting material and the intended use. Thus, not only is a defined degree of opening up of the hide and swelling achieved, and not only is the dependence on the quality of the starting material reduced—which in itself would be a great advantage—but also the liming can be carried out continuously, since all chemicals are completely dissolved and can therefore be easily separated from the liming sludge and be re-employed, which in turn entails great savings of chemicals and, in particular, a substantial reduction in the pollution of the effluent, especially since no toxic constituents (e.g. sulfides) are employed. Hence, the process is cheaper, faster, safer and less detrimental to the environment than are the conventional processes, and gives a better end product than these. The invention overcomes an established prejudice, by those skilled in the art, to the use of caustic alkali in liming. For example, H. Herfeld, loc. cit., page 94 and 95, states: "from all these arguments it can be deduced, in accordance with practical experience, that alkali metal hydroxides can virtually be disregarded as chemicals for loosening the hair, since, due to their low hair-loosening power, relatively high concentrations would be required, which in turn would cause excessive swelling and greater hydrolysis, which is undesirable, since it would severely strain and attack the entire fiber structure, reduce the strength characteristics and often result in a loose and spongy character of the leather".

Surprisingly, we have found it possible to avoid these disadvantages by adding the above salts.

In hair-destroying liming, relatively short liquors with high sodium hydroxide concentrations (from about 100 to 150 g/l) are employed, an advantageous procedure being to start the liming with a short liquor, at a fairly high alkali concentration and fairly low salt concentration, and to add the remaining salt solution subsequently (after the pulping or loosening of the hair). In hair-saving liming, it is preferred to work with long liquors at lower alkali concentrations (from about 15 to 50 g/l).

The length (relative quantity) of the liquor can, as is conventionally the case, be from 20 to 250%, preferably from 30 to 150%, based on the cured weight of the hides.

The liming temperature and liming time may also lie within the conventional range, i.e. from 10° to 30° C., preferably from 25° to 28° C., and from 8 to 48 hours, preferably from 12 to 16 hours, respectively.

The process can be carried out in conventional vessels, preferably drums, paddle-vats, mixers and Y-drums.

Particularly good removal of the hair and opening up of the hide is achieved by additionally employing hydrotropic substances (defined, for example, in H. Römpp, Chemielexikon, 6th edition, Frank'sche Verlagshandlung Stuttgart, 1966, page 2838), i.e., in the main, water-soluble salts of organic acids, especially of sulfonic acids, carboxylic acids, hydroxysulfonic acids or sulfocarboxylic acids, especially salts of 4-sulfophthalic acid. Advantageously, from 2 to 20 g of hydrotropic substance are employed per liter of liming liquor.

To carry out the process continuously, the liming composition containing sodium hydroxide, sodium sulfate and/or a dicarboxylic acid salt and, preferably, a hydrotropic substance is allowed to stand or run overnight, for example, the liquor is then run off, separated from the sludge by decanting, filtering or centrifuging, restored to the desired starting concentration by adding sodium hydroxide, sodium sulfate and/or the salt of the dicarboxylic acid and the hydrotropic substance, and used to start a new cycle. It is also possible, as described in Example 2, first to mix a part of the clarified liming liquor, which is to be re-used, with the entire amount of sodium hydroxide required to restore the initial amount, and use this mixture to bring about substantial loosening or pulping of the hair, in a 1st stage, before adding the remainder of the liquor to be recirculated.

In the Examples, the percentages (which are by weight) relate to the cured weight of the raw leather. The latter is cattle hide and is soaked thoroughly, in the conventional manner.

EXAMPLE 1

Hair-destroying liming process
Liming composition:
40% of a solution of Na adipate, containing 150 g/l
8% of a 50% strength Na hydroxide solution
drum for 3 hours, then add:
60% of a Na adipate solution, containing 150 g/l
drum for 30 minutes
lime overnight.

EXAMPLE 2

Hair-destroying liming process, 1st cycle
20% of Na sulfate solution, containing 100 g/l
10% of 50% strength Na hydroxide solution
drum for 3 hours
+130% of Na sulfate solution containing 100 g/l
drum for 1 hour,
lime overnight,
collect the liquor,
separate off the sludge.
2nd and subsequent cycles
20% of clarified liming liquor (recirculated liquor)
6% of 50% strength Na hydroxide solution
drum for 3 hours,
then add
80% of clarified liming liquor (recirculated liquor)
45% of water
2% of Na sulfate
lime overnight,
collect the liquor,
separate off the sludge.

EXAMPLE 3

1st cycle, hair-destroying liming process
60% of Na sulfate solution, containing 150 g/l
20% of Na adipate solution, containing 150 g/l
10% of 50% strength Na hydroxide solution
drum for 3 hours,
lime overnight,
collect the liquor,
the clarified residual liming liquor can be re-used.

EXAMPLE 4

Hair-saving liming process
150% of Na sulfate solution, containing 100 g/l
50% of Na adipate solution, containing 100 g/l
8% of 50% strength Na hydroxide solution
0.5% of 4-sulfophthalic acid
drum for 3 hours,
lime overnight,
unhair,
the residual liquor can be re-used.

Examples 1 to 4 each have satisfactorily unhaired hides which showed an optimum degree of opening up for the subsequent tanning, and were not excessively swollen.

We claim:

1. A lime-free and sulfide-free process for liming skins and hides which comprises treating the hair-bearing animal skins or hair-bearing animal hides with a mixture of (a) sodium hydroxide solution, (b) at least one sodium salt of dicarboxylic acids of 3 to 6 carbon atoms, and (c) sodium sulfate, wherein the sodium hydroxide solution loosens the attachment of the hair to the hides or skins, the proportion of the sodium salt of dicarboxylic acids in the sum of components (b) and (c) being at least 10% by weight, and wherein said components (b) and (c) are agents for controlling swelling of the skins or hides.

2. A process as set forth in claim 1, wherein the proportion of the sodium salt of dicarboxylic acids in the sum of components (b) and (c) is at least 30% by weight.

3. A process as set forth in claim 1, wherein said sodium salt of dicarboxylic acids is the sodium salt malonic acid, succinic acid, glutaric acid, adipic acid, maleic acid or furmaric acid.

4. A process as set forth in claim 1, wherein the sodium hydroxide concentration in the liming liquor is from 15 to 150 g/l, the minimum amount of sodium hydroxide being 2%, based on the cured weight of the hide.

5. A process as set forth in claim 1, wherein the total concentration of sodium sulfate and sodium salts of dicarboxylic acids of 3 to 6 carbon atoms in the liming liquor is from 50 to 200 g/liter.

6. A process as set forth in claim 1, wherein from 2 to 20 g/l of substances which have a hydrotropic action on protein are additionally employed.

7. A process as set forth in claim 1, wherein continuous operation is employed in which after conclusion of a liming cycle, the sludge is separated from the solution, and the latter is employed for a new cycle after reinstatement of the initial concentration of sodium hydroxide, sodium sulfate and salts of dicarboxylic acids, with or without a hydrotropic substance.

* * * * *